United States Patent [19]

Skripek et al.

[11] 4,075,084

[45] Feb. 21, 1978

[54] MANUFACTURE OF LOW-SULFUR NEEDLE COKE

[75] Inventors: Milan Skripek, Fullerton; John H. Duir, Yorba Linda, both of Calif.

[73] Assignee: Union Oil Company of California, Los Angeles, Calif.

[21] Appl. No.: 769,421

[22] Filed: Feb. 17, 1977

[51] Int. Cl.[2] ..... C10B 57/02; C10G 9/14

[52] U.S. Cl. ..... 208/93; 208/50; 208/92; 208/131

[58] Field of Search ..... 208/92, 93, 131, 50, 208/89, 85; 423/445, 448, 449

[56] References Cited

U.S. PATENT DOCUMENTS

| | | | |
|---|---|---|---|
| 2,775,549 | 12/1956 | Shea | 208/131 X |
| 3,480,540 | 11/1969 | Eng et al. | 208/93 |
| 3,817,853 | 6/1974 | Folkins | 208/50 |
| 3,891,538 | 6/1975 | Walkey | 208/50 |
| 3,902,991 | 9/1975 | Christensen et al. | 208/50 X |
| 4,005,006 | 1/1977 | Montagna | 208/89 |

*Primary Examiner*—Edward J. Meros
*Attorney, Agent, or Firm*—Lannas S. Henderson; Richard C. Hartman; Dean Sandford

[57] ABSTRACT

High grade, low-sulfur needle coke is produced from heavy high-sulfur aromatic mineral oil feedstocks by a sequence of (1) fractionating the feedstock into a minor heavy fraction, and a major lighter fraction, (2) subjecting the lighter fraction to mild hydrofining, (3) blending the heavy fraction separated in step (1) with the heavy fraction of hydrofined oil from step (2), (4) subjecting the resulting blend to delayed thermal coking, and preferably (5) recycling to the coking step heavy coker gas oil recovered from the coker effluent. If desired, the aromaticity of the heavy hydrofined oil from step (2) can be increased by subjecting the same to thermal cracking prior to step (3).

18 Claims, 1 Drawing Figure

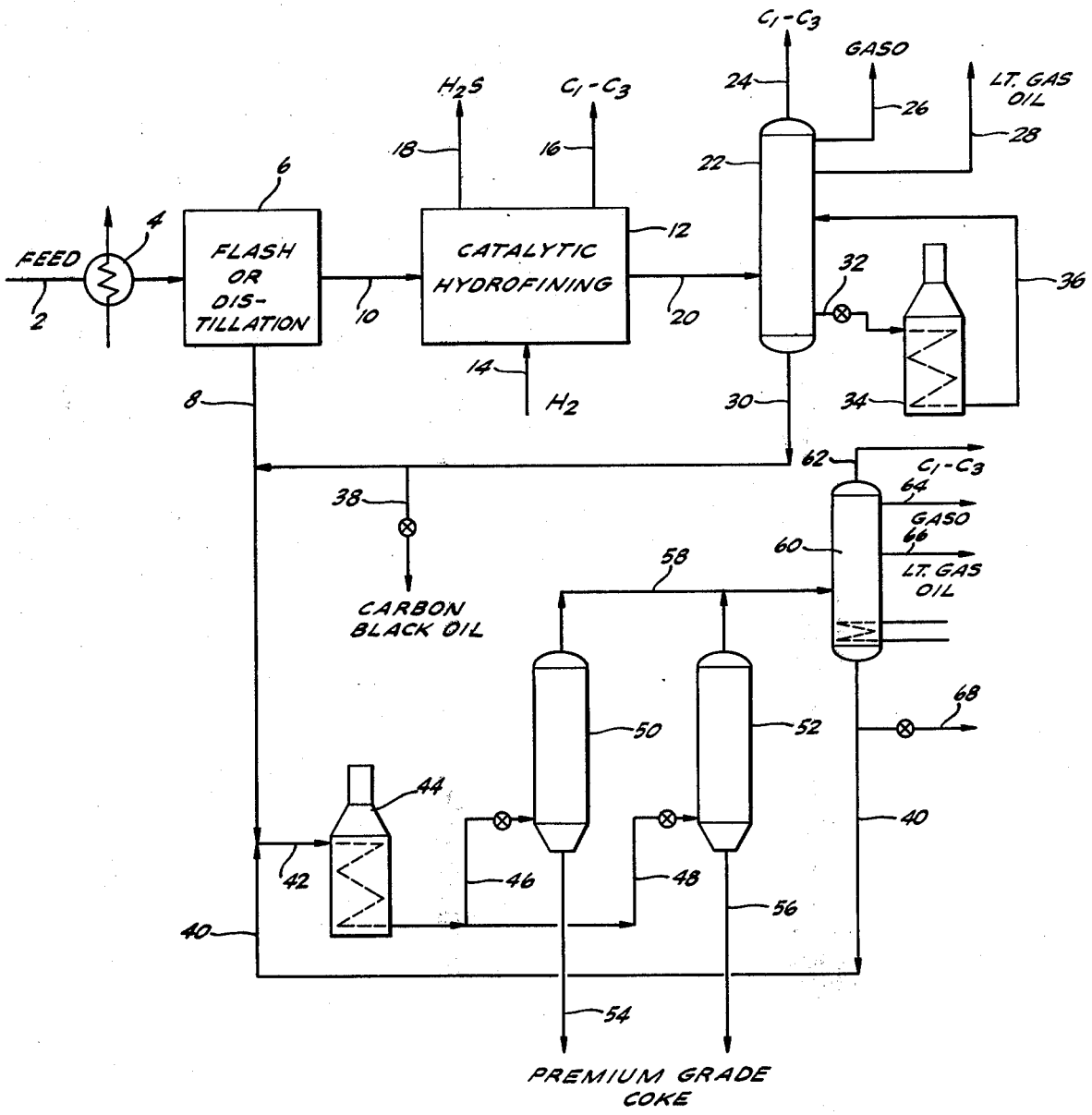
FEED
2
4
6
FLASH OR DIS-TILLATION
10
8
$H_2S$
18
$C_1-C_3$
16
CATALYTIC HYDROFINING
12
14
$H_2$
20
$C_1-C_3$
24
GASO
26
LT. GAS OIL
28
22
32
34
36
30
38
CARBON BLACK OIL
62
$C_1-C_3$
64
GASO
66
LT. GAS OIL
60
58
50
52
68
44
42
46
48
56
40
40
54
PREMIUM GRADE COKE

MANUFACTURE OF LOW-SULFUR NEEDLE COKE

BACKGROUND AND SUMMARY OF INVENTION

There is a great demand in industry for low-sulfur needle coke which can be processed into premium quality graphite, in particular graphite having a relatively low coefficient of thermal expansion, between about 1-10, preferably 1-5, in./in./° C $\times 10^{-7}$. Such graphite is used in the manufacture of anodes for the steel industry. Unfortunately, there is an increasing scarcity of the highly aromatic, low-sulfur petroleum feedstocks required for the manufacture of such premium coke. Ideally, the feedstock should contain at least about 75 volume percent aromatics, less than about 0.5 weight-percent sulfur, less than about 1 weight-percent asphaltenes, and should contain a major proportion of hydrocarbons boiling above 600° F, and a substantial proportion boiling above 800° F.

Feedstocks meeting the above requirements, except for the low sulfur requirement, are abundant in the refining industry. Examples of such feedstocks include decant oils derived from fluid catalytic cracking, heavy coker gas oils, pyrolysis and thermal tars, certain low-asphaltene residual oils, and the like. One obvious approach to the problem would be to subject such feedstocks to catalytic hydrofining to reduce sulfur levels to acceptable values. However, this approach involves two principal difficulties. Firstly, many of such oils contain suspended particulate matter, such as catalyst fines suspended in decant oils, which tend to cause plugging and deactivation of catalyst beds. Also, such oils often contain metals such as vanadium, iron and nickel which may deactivate the hydrofining catalyst. The second major difficulty involves the problem of achieving adequate desulfurization without also hydrogenating a significant portion of the aromatic hydrocarbons, particularly the polycyclic hydrocarbons which are the most desirable coke precursors. This problem is particularly aggravated in the case of feedstocks which have a high carbon residue (e.g., Conradson carbon). These highly carbonaceous feeds require high hydrogen pressures in the hydrofining zone in order to prevent rapid deactivation of the catalyst by coke deposition. Under such circumstances, it is difficult to avoid extensive hydrogenation of aromatics.

We have now discovered that the foregoing problems can be solved or greatly alleviated by our process described herein, which involves as the first step, separating the feedstock into a minor heavy fraction which will be relatively high in Conradson carbon, and will contain any suspended particulate matter and metals, and a major lighter fraction which will be lower in Conradson carbon and substantially free of particulate matter and matals. The lighter fraction is then subjected to catalytic hydrofining at relatively low hydrogen pressures, correlated with temperature and space velocity so as to avoid any substantial hydrogenation of aromatic hydrocarbons, but yet reduce the sulfur content sufficiently so that when the hydrofined product oil is reblended with the heavy fraction from the initial separation step, a blend is obtained having a sufficiently low sulfur content to yield the desired premium grade of low-sulfur coke. The coking operation is further enhanced by recycling to extinction therein the heavy coker gas oil produced. An optional feature of the process involves subjecting the high boiling fraction of effluent from the catalytic hydrofiner to thermal cracking to convert the same to a lighter, hydrogen-rich fraction, and a fraction heavier and more aromatic than the heaviest fraction of hydrofiner effluent. This heavy polymeric effluent from the thermal cracker is then blended with the heavy fraction obtained from the initial fractionation of fresh feed.

PRIOR ART

U.S. Pat. No. 3,817,853 discloses a process wherein a pyrolysis tar is first hydrogenated to saturate olefinic hydrocarbons, and is then subjected to coking. The stated purpose in hydrogenating the olefins is to prevent premature coking of feedstock in the coker heating coils; there is no teaching of desulfurization, and the only specific feedstock disclosed is already sufficiently low in sulfur to give a premium grade coke. The problem of producing a premium grade coke from the high sulfur feedstocks required herein is not addressed by the patentee. It is well known in the art that olefins can be saturated under much milder conditions than those generally required for desulfurization or for saturation of aromatics.

U.S. Pat. No. 3,891,538 discloses a combination process wherein a residual feedstock is first subjected to hydrodesulfurization, and is then fractionated to produce a gas oil for catalytic cracking, and a heavy bottoms fraction for coking. Decant oil from the catalytic cracking zone is also sent to the coking zone. Although the coke formed in this process may or may not be low in sulfur, a premium needle coke would not be produced because the coker feed includes the entire asphaltene fraction from the initial feedstock, and none of the coker gas oil is recycled back to the coking zone. This process also entails the expense of hydrogenating much more, instead of less, than the entire feed to the coker.

BRIEF DESCRIPTION OF DRAWING

The attached drawing is a schematic flow diagram illustrating one preferred mode of practicing the invention.

DETAILED DESCRIPTION

The raw feedstocks utilized herein may be characterized in general as heavy, highly aromatic mineral oil fractions having an API gravity between about −6° and +15° and a hydrogen content between about 6.5 and 12, preferably between about 6.5 and 9 weight-percent. Its 50% boiling point should preferably be in excess of about 600° F, and it should contain at least about 10 weight-percent of material boiling above 800° F. The Conradson carbon content of such feeds may range between about 5 and 25 percent and the aromatics content should be at least about 75%, preferably at least 85% by weight. The UOP characterization factor for such feeds falls within the range of about 8 to 12. In order to justify the cost of the process, the feed should contain at least about 0.7 weight-percent, and usually at least about 1 weight-percent sulfur.

Feedstocks of the above nature can be derived from several sources, including petroleum, shale oil, tar sands, coal, and the like. Exemplary feedstocks include decant oils derived from fluid catalytic cracking processes, pyrolysis tars derived from the high temperature (e.g. 1800°-2000° F) thermal cracking of mineral oils to produce light olefins, thermal tars, heavy coker gas oils, and the like. Certain types of atmospheric residual oils containing less than about 10 percent and preferably less than about 5 percent by weight of asphaltenes may also be utilized. Asphaltenes in the coker feedstocks inhibit the formation of the desired needle coke. Asphaltenes are defined herein as pentane-insoluble material.

Referring now to the drawing, raw feed to the process is brought in via line 2, preheated in heater 4 and then sent to fractionation unit 6, which may comprise either a single-stage vacuum flashing unit, or a multistage vacuum distillation unit. Bottoms from the distillation unit is removed via line 8, and will comprise between about 3 percent and 50 percent, preferably about 5–30 percent by weight of the raw feed. The remaining portion of raw feed is taken overhead via line 10.

The optimum cut point, or relative proportions of overhead and bottoms recovered from unit 6, depends on a number of factors, mainly the sulfur content of the initial feed and the Conradson carbon content thereof. For high-sulfur feeds it is usually preferred to take overhead at least about 85 percent of the raw feed, but it may be desirable to reduce this value somewhat if the raw feed has a carbon residue above about 15 percent. In order to avoid rapid deactivation of the hydrofining catalyst in hydrofining unit 12, or the alternative of resorting to high hydrogen pressures therein with resultant increase in aromatics hydrogenation, the carbon residue of the overhead fraction to be desulfurized therein should be less than about 5%, and preferably less than about 3%. In the case of relatively low-sulfur, low-carbon-residue feedstocks, it is usually desirable to minimize overhead production in order to reduce the cost of fractionation and the size of the catalytic hydrofining unit, as well as to minimize the proportion of aromatic hydrocarbons which will be subject to hydrogenation therein.

Hydrofining unit 12, to which hydrogen is fed via line 14, is a conventional reactor combination with the usual gas-liquid separators and an amine scrubbing unit to remove $H_2S$ from the recycle gas. Fuel gas is removed from the low pressure separator via line 16, while $H_2S$-rich gases are removed via line 18. The catalyst utilized in the hydrofining unit is preferably a conventional presulfided composite of cobalt oxide and molybdenum oxide supported on alumina, but any combination of an iron group metal with a Group VIB metal supported on a refractory oxide carrier may be utilized. Operative hydrofining process conditions may be summarized as follows:

| | Hydrofining Conditions | |
|---|---|---|
| | Broad Range | Preferred Range |
| Temp., ° F | 500 – 800 | 600 – 750 |
| Pressure, psig | 500 – 1500 | 600 – 1200 |
| $H_2$/Oil, SCF/B | 500 – 4000 | 1000 – 2000 |
| LHSV | 0.2 – 6 | 0.5 – 2 |

The selection of an appropriate combination of conditions from the above ranges will of course depend upon the nature of the particular feedstock involved, and the economic environment in which the process is being practiced. In general, the combination of relatively high temperatures with high space velocities and low pressure favors desulfurization versus hydrogenation of aromatics, but also tends to favor more rapid deactivation of the catalyst, a factor which in turn depends also upon the carbon residue of the hydrofiner feedstock. For feedstocks containing more than about 2.5 weight-percent Conradson carbon, it is generally preferred to use pressures in the 800–1500 psig range, and temperatures in the 650°–750° range. Those skilled in the art will understand however that a precise correlation of optimum reaction conditions for any given feedstock is basically an economic evaluation which can only be undertaken in connection with specific process objectives which form no essential part of the present invention.

For purposes of the present invention, the critical hydrofining requirements are simply that the overall severity of conditions should be adjusted to effect at least about 50% desulfurization of the feed and give a liquid effluent containing less than about 0.6 wt.% sulfur, while limiting hydrogen consumption so that the hydrogen content of the 500° F+ fraction of hydrofiner effluent will be less than: (a) about 10.5, preferably less than about 9, weight-percent if said fraction is to be used directly as coker feedstock, or (b) less than about 13 weight-percent if said fraction is to be subjected to thermal cracking as hereinafter described.

Liquid effluent from hydrofining unit 12 is transferred via line 20 to fractionating column 22, from which light gases, gasoline and light gas oil boiling below about 550°–600° F, are taken off as overhead or side-cut products via lines 24, 26, and 28. In many cases, the 550° F+ to 600° F+ bottoms fraction removed via line 30 will have a hydrogen content less than about 10.5 weight-percent, and may without further treatment form a suitable coker feedstock after reblending with the bottoms fraction from fractionating unit 6. However, in some cases, as where the initial raw feed had a high hydrogen content, and/or where it was necessary to use relatively high hydrogen pressures in hydrofining unit 12, the bottoms fraction in line 30 may be found to have a high hydrogen content ranging between about 10.5 and 13 weight-percent. Such material does not form a suitable coking feedstock, and in such cases it will be found desirable to divert 650° F+ material from the bottom of column 22 via line 32 for treatment in thermal cracker 34. This alternative may also be utilized in cases where the bottoms fraction contains as little as 8 percent hydrogen, if it is desired to maximize coke yields and quality.

In thermal cracker 34, temperatures of about 900°–1100° F, and pressures of about 300–800 psig are maintained, whereby feed to the cracker is converted to lighter, hydrogen-rich hydrocarbons, and to a heavy polymeric residue amounting to about 40–80 weight-percent of the cracker feed. Effluent from the cracker is then recycled via line 36 back to column 22. By operating in this manner the column bottoms in line 30 will have an initial boiling point between about 600° and 900° F, and will have a hydrogen content below about 10, preferably below about 8 weight-percent. This material is an excellent coker feedstock, and is also a high quality carbon black oil, a portion of which may if desired be withdrawn via line 38 for the production of premium carbon black. In any event, all or a major portion of the bottoms fraction in line 30 is blended with all or a portion of the bottoms fraction in line 8 to form the desired raw coking feedstock. If the bottoms from fractionator 6 contains asphaltenes, the proportion of such material blended with the desulfurized fraction should be such that the final blend contains less than 5 and preferably less than 1 weight-percent asphaltenes. It should however have a hydrogen content below about 9, and preferably below about 8 weight-percent.

The raw coker feedstock in line 8 is then blended with heavy coker recycle gas oil from line 40, and the resulting mixture is passed via line 42 through coking preheater 44, wherein it is heated to temperatures in the range of about 875°–975° F and then passed either via line 46 or line 48 into one of cokers 50 or 52. It will be understood that cokers 50 and 52 operate on alternate coking and decoking cycles of about 12–36 hours; while one drum is being filled with coke the other is being decoked. Average drum temperatures during the coking cycle range between about 850° and 950° F, and coking pressures range between about 10 and 200 psig. At the end of each coking cycle, premium needle coke containing less than about 1 weight-percent sulfur is removed via either line 54 or 56 from the coke-filled drum by hydraulic jets of water or other conventional means, while the coker feedstock is diverted to the other drum.

The overhead from whichever drum is on-stream is passed via line 58 to fractionating column 60, from which fuel gases, gasoline and light gas oil boiling up to about 550°–600° F are recovered via lines 62, 64 and 66. Heavy coker gas oil with an initial boiling point between about 550° and 900° F is recycled via line 40 as previously described.

The foregoing description of the operation of column 60 presumes that coke drums 50 and 52 are being operated at relatively low pressures of e.g. 10–50 psig, and that the column is operated at essentially the same pressures. Under these conditions, a substantial amount of coker distillate having an atmospheric boiling point up to about 900° F will pass overhead into the column, and be removed therefrom as recycle bottoms in line 40. However, in a preferred mode of operation the coking drums are operated at somewhat elevated pressures of about 75–175 psig and the fractionating column is operated at the same or slightly lower pressures. Under these conditions little if any material having an atmospheric boiling point above about 650°–700° F will pass overhead into the column, but will remain in the coking drum and be coked therein. In such cases, where the bottoms from column 60 does not contain in the fraction having an atmospheric initial boiling point of about 550° F, a substantial proportion, i.e., at least about 50 volume-percent, of material having an atmospheric boiling point above about 600° F, such fraction does not form a desirable coking feedstock, and would not normally be recycled, but is diverted from the process via line 68 for other uses.

From the foregoing it will be apparent that operating the coking drums at elevated pressures, and the recycling of heavy coker gas oil from column 60 are essentially alternative procedures. Within their described limitations, each is a desirable procedure, leading to improved yields and quality of coke. When the coking is carried out at intermediate pressures of e.g. 30–60 psig, it may be desirable to increase the end boiling point of the light gas oil fraction in line 66 to e.g. 650° F, and recycle via line 40 only the 650° F+ material.

The following non-limiting examples illustrate the results obtainable by the described process.

EXAMPLE 1

A fluid catalytic cracking decant oil was vacuum fractionated into a 1000° F end-point 90% overhead fraction and a 10% bottoms residue, by volume. The overhead fraction was then hydrofined over a presulfided 4% CoO-12% $MoO_3$ on $Al_2O_3$ catalyst at 690° F, 0.3 LHSV, 800 psig and 3000 SCF/B of hydrogen. The principal characteristics of the raw feed, the separated fractions and the hydrofined product were as follows:

Table 1

| | Raw Feed | 90% Overhead | 10% Bottoms | 500° F+ Hydrofined Overhead |
|---|---|---|---|---|
| Gravity, ° API | 31 1.9 | 0.5 | −15.6 | 9.0 |
| Carbon Residue, Wt. % | 10.0 | 2.0 | 73 | 0.47 |
| 50% Boiling Pt, ° F | 800 | 781 | — | 733 |
| Weight-Percent | | | | |
| Sulfur | 3.1 | 3.2 | 2.1 | 0.16 |
| Hydrogen | 7.5 | 7.9 | — | 9.3 |
| Polynuclear[1] Aromatics | — | 57.8 | — | 55.3 |
| Mononuclear[1] Aromatics | — | 2.0 | — | 34.1 |

[1]Hydrocarbons only; the increase in total aromatics in the hydrofined fraction is due mainly to the decomposition of aromatic sulfur compounds.

EXAMPLE 2

Portions of the raw feed, the 90% overhead fraction, the 10% botts and the hydrofined overhead from Example 1, as well as a blend of 90% hydrofined overhead and 10% botts, were subjected to delayed coking at an average drum temperature of 875° F and a pressure of 90 psig for 4-hour run durations, with the following results:

Table 2

| Coke Derived From: | Coke Yield, Wt. % | Wt. % S In Coke | VCM,[2] Wt. % |
|---|---|---|---|
| Raw Feed | 34 | 2 | 7[1] |
| 90% Overhead | 28.8 | 2.7 | 10.4 |
| 10% Botts | 34.4 | 1.7 | 8.4 |
| Hydrofined Overhead | 7.3 | 0.23 | 15.4 |
| Blend, 10% Botts, 90% Hydrofined Overhead | 16.4 | 0.8 | 9.0 |

[1]Average from 2 runs
[2]Volatile Combustible Matter

It is apparent that hydrofining tends to reduce coke yields, but this can be remedied by operating at higher coking pressures, recycling heavy coker gas oil and/or by thermally cracking the heavy portion of the hydrofined overhead.

EXAMPLE 3

The green coke samples from Example 2 were first calcined at 2550° F, and then after analysis of the calcined samples, were mixed with 27.5% Barrett #30 pitch, extruded into 0.75 inch diameter rods, baked at 10° C/hr to 1000° C, and then graphitized at 2700° C. Properties of the calcined cokes and graphites were as follows:

Table 3

| Sample derived from: | S in Coke, Wt. % | Coke Density, Real, g/cm$^3$ | CTE[1] of Graphite |
|---|---|---|---|
| Raw Feed | 2 | 2:1 | 5[2] |
| 90% Overhead | 2.24 | 2.06 | 5.9 |
| 10% Botts | 1.6 | 2.1 | 6.2 |
| Hydrofined Overhead | 0.11 | 2.06 | 10.1 |
| Blend, 10% Botts, 90% Hydrofined Overhead | 0.71 | 1.92 | 7.7 |

[1]Coefficient of Thermal Expansion, inch/inch/° C × $10^{-7}$.
[2]Average from 2 runs.

It will be seen that the only coking feedstock giving the combined advantages of a reasonably high coke yield, an acceptably low sulfur content in the coke, and a graphite having an acceptable CTE was the 10% botts, 90% hydrofined overhead blend.

The following claims and their obvious equivalents are believed to define the true scope of the invention.

We claim:

1. A process for the manufacture of needle coke containing less than about 1 weight-percent sulfur from an aromatic mineral oil feedstock having an API gravity between about −6° and +15°, boiling predominantly above about 600° F and containing about 6.5 – 9 weight-percent hydrogen and more than about 0.7 weight-percent sulfur, which comprises:
   1. fractionally distilling said feedstock so as to separate a major overhead fraction from a minor bottoms fraction, any asphaltenes present in said feedstock being concentrated in said bottoms fraction;
   2. subjecting said overhead fraction to catalytic hydrofining at a temperature correlated with hydrogen pressure and space velocity so as to effect at least about 50% desulfurization of said fraction without raising the hydrogen content of the 500° F+ hydrofiner effluent above about 10.5 weight-percent;
   3. recovering from step (2) a heavy hydrofined fraction boiling predominantly above 600° F and blending the same with at least a portion of said minor bottoms fraction so as to form a coking feedstock containing less than about 5 weight-percent asphaltenes; and
   4. subjecting said coking feedstock to delayed thermal coking at a temperature correlated with pressure so as to give a needle coke and a coker distillate.

2. A process as defined in claim 1 wherein said mineral oil feedstock is a fluid catalytic cracking decant oil containing suspended catalyst fines.

3. A process as defined in claim 1 wherein said mineral oil feedstock is a pyrolysis tar.

4. A process as defined in claim 1 wherein said mineral oil feedstock is a heavy coker gas oil boiling above about 600° F and containing at least about 10% of material boiling above 800° F.

5. A process as defined in claim 1 wherein said minor bottoms fraction comprises about 5–30 weight-percent of said mineral oil feedstock.

6. A process as defined in claim 1 wherein said coking step (4) is carried out at a pressure between about 75 and 175 psig.

7. A process as defined in claim 1 wherein said coker distillate is fractionated to recover a heavy gas oil boiling mainly above 600° F, and said heavy gas oil is recycled to said coking step (4).

8. A process as defined in claim 7 wherein said hydrofiner effluent contains less than about 9 weight-percent hydrogen.

9. A process as defined in claim 7 wherein said overhead fraction recovered in step (1) has a Conradson carbon residue of less than about 5%.

10. A process for the manufacture of needle coke containing less than about 1 weight-percent sulfur from an aromatic mineral oil feedstock having an API gravity between about −6° and +15°, boiling predominantly above about 600° F and containing about 6.5 – 13 weight-percent hydrogen and more than about 0.7 weight-percent sulfur, which comprises;
   1. fractionally distilling said feedstock so as to separate a major overhead fraction from a minor bottoms fraction, any asphaltenes present in said feedstock being concentrated in said bottoms fraction;
   2. subjecting said overhead fraction to catalytic hydrofining at a temperature correlated with hydrogen pressure and space velocity so as to effect at least about 50% desulfurization of said fraction;
   3. recovering from step (2) a heavy hydrofined fraction boiling predominantly above 600° F and containing between about 8 and 13 weight-percent hydrogen;
   4. subjecting said heavy hydrofined fraction to thermal cracking at a temperature between about 900° and 1100° F and recovering therefrom a polymeric bottoms fraction boiling above about 600° F and having a reduced hydrogen content;
   5. blending said polymeric bottoms fraction with at least a portion of said minor bottoms fraction to form a coking feedstock containing less than about 5 weight-percent asphaltenes; and
   6. subjecting said coking feedstock to delayed thermal coking at a temperature correlated with pressure so as to give a needle coke and a coker distillate.

11. A process as defined in claim 10 wherein said mineral oil feedstock is a fluid catalytic cracking decant oil containing suspended catalyst fines.

12. A process as defined in claim 10 wherein said mineral oil feedstock is a pyrolysis tar.

13. A process as defined in claim 10 wherein said mineral oil feedstock is a heavy coker gas oil boiling above about 600° F and containing at least about 10% of material boiling above 800° F.

14. A process as defined in claim 10 wherein said minor bottoms fraction comprises about 5–30 weight-percent of said mineral oil feedstock.

15. A process as defined in claim 10 wherein said coking step (6) is carried out at a pressure between about 75 and 175 psig.

16. A process as defined in claim 10 wherein said coker distillate is fractionated to recover a heavy gas oil boiling mainly above 600° F, and said heavy gas oil is recycled to said coking step (6).

17. A process as defined in claim 16 wherein said heavy hydrofined fraction contains between about 10.5 and 13 weight-percent hydrogen.

18. A process as defined in claim 16 wherein said overhead fraction recovered in step (1) has a Conradson carbon residue of less than about 5%.

* * * * *